United States Patent [19]

Stump

[11] Patent Number: 4,719,721

[45] Date of Patent: Jan. 19, 1988

[54] CONVEYOR BED ASSEMBLY AND VACUUM PLATEN

[75] Inventor: Lee E. Stump, Brooklyn Park, Minn.

[73] Assignee: Timesavers, Inc., Minneapolis, Minn.

[21] Appl. No.: 943,168

[22] Filed: Dec. 18, 1986

[51] Int. Cl.[4] ..... B24B 21/00

[52] U.S. Cl. ..... 51/138; 198/689.1; 51/141; 51/215 E; 51/235

[58] Field of Search ..... 51/138, 135 R, 137, 51/141, 235, 215 E; 198/689.1, 631, 463.3; 29/DIG. 78

[56] References Cited

U.S. PATENT DOCUMENTS

| | | |
|---|---|---|
| 980,052 | 12/1910 | Blevney et al. . |
| 3,167,889 | 2/1965 | Jacobi . |
| 3,170,272 | 2/1965 | Burnham . |
| 3,221,448 | 12/1965 | Heesemann . |
| 3,408,775 | 11/1968 | Rutt . |
| 3,438,154 | 4/1969 | Vichi . |
| 3,541,736 | 11/1970 | Takekawa . |
| 3,553,899 | 1/1971 | Hasegawa . |
| 3,570,190 | 3/1971 | Rutt et al. . |
| 3,859,757 | 1/1975 | Heesemann . |
| 3,889,801 | 6/1975 | Boyer . |
| 4,084,356 | 4/1978 | Brears . |
| 4,258,506 | 3/1981 | Robinson . |
| 4,343,113 | 8/1982 | van der Linden . |

*Primary Examiner*—Frederick R. Schmidt
*Assistant Examiner*—Maurina Rachuba
*Attorney, Agent, or Firm*—Orrin M. Haugen; Thomas J. Nikolai; Frederick W. Niebuhr

[57] ABSTRACT

A wide belt orbiting sander having an improved workpiece conveyor system, wherein a plurality of resiliently biased platen segments are utilized to apply a force against the underside of the upper conveyor flight in oppositely disposed relationship to the sanding heads. The platen includes a number of individual segments, each segment occupying a certain finite portion of the transverse dimension of the conveyor, and with each of the platen segments being mounted for rocking and pivotal motion about both longitudinal and transverse axes. Wide belt sanders equipped with the improved conveyor system of the present invention are capable of handling a wide variety of workpieces including workpieces of variable and varying dimensions.

2 Claims, 7 Drawing Figures

CONVEYOR BED ASSEMBLY AND VACUUM PLATEN

BACKGROUND OF THE INVENTION

The present invention relates generally to wide belt orbiting sanding machines, and more particularly to an improved workpiece conveyor system which is designed to move or otherwise carry the individual workpieces through the machine and its various work stations and where operations are undertaken by the sanding machine on the workpieces. More specifically, the present invention relates to an improved base platen and force-applying and responding means which is operatively positioned on the underside or undersurface of the upper conveyor flight so as to provide uniform force and/or pressure on the individual workpieces toward the orbiting belt as they are carried on the conveyor and passed through the work station of the sanding machine.

Wide belt sanders with orbiting abrasive belts are relatively well-known, with one such apparatus being disclosed and claimed in the U.S. patent to Kiser and Stinn, U.S. Pat. No. 3,832,807, assigned to the same assignee as the present application. Generally, in such sanding apparatus, one or more and typically two individual sanding heads are provided, each employing an endless wide abrasive belt trained over individual rollers or drums, at least one of which is power-driven to impart the high speed orbital motion to the belt. In the apparatus illustrated herein, two individual sanding heads, tandemly arranged, are provided, each of which is disposed vertically above the horizontal conveyor so as to provide engagement or operative contact between the upper surface of the workpieces being fed through the machine and the surface of the abrasive belt. Specifically, in the apparatus disclosed herein, the first sanding head is in the form of a contact drum, with the second being in the form of a platen. Typically, dimensioning occurs in the drum station, while finishing occurs in the platen station.

In the utilization of wide belt sanding machines, it frequently occurs that a number of individual workpieces will be passed through the machine on a continuous but random basis. Given the width of the apparatus, at any given point in time, more than one individual or separate workpiece may be in contact with the individual sanding heads. Frequently, these individual workpieces may have somewhat different or varying thickness dimensions, thereby making it become necessary to modify the distance between the top surface of the upper conveyor flight and the surface of the abrasive belt as it moves across the sanding head; that is increasing the distance for the thicker pieces without rendering the apparatus ineffective for thinner workpieces. In order to accommodate these individual workpieces with differing thickness dimensions, the conveyor is designed to have a plurality of elongated hollow platen segments collectively forming a single platen, each being of rectangular parallepipedon configuration disposed in side-by-side relationship across the transverse dimension or width of the conveyor. The individual axes of the hollow platen segements are generally parallel, one to the other, and to the axis of the upper flight of the conveyor belt. Air bladder means are positioned or disposed along the underside of the platen segments, that is between the conveyor frame and the opposed ends of the elongated platens so as to provide a resilient force urging the individual platen segments against the undersurface of the conveyor belt. In order to reduce friction with the conveyor belt, and in order to retain a vacuum seal with the workpieces, as set forthmore fully hereinafter, the upper surface of the individual platen segments is generally smooth and polished. Also, to provide for appropriate motion of the workpieces along and through the work stations, a number of pinch rollers are provided which press and guide the workpieces down onto and against the surface of the conveyor belt. Typically, these pinch rollers are disposed directly above the elongated platens adjacent the longitudinal ends, thus providing for and maintaining co-action between the pinch rollers and the conveyor belt. The presence of air bladders at opposed ends of the elongated platen segments assists in accommodation of the workpieces of different or varying thickness dimension passing between the top surface of the conveyor belt and a plane tangent to the lower circumference of the pinch rollers.

Wide belt sanders of the present invention are normally utilized to perform two significantly different operations, specifically the initial dimensioning of lumber, panels, or other workpieces, as well as the finish sanding of such workpieces. In finish sanding operations, articles of larger dimension may be employed such as plywood panels, doors such as cabinet doors, and the like. In order to accommodate these individual operations, the individual workpieces must be held securely for the individual operations, and particularly securely when undergoing the dimensioning operation. Additionally, it is normally desired that the work be held securely during the finishing operations in order that the individual workpieces move continuously and consistently with the conveyor belt, and thereby avoid impact or rubbing contact with adjacent or neighboring workpieces.

In order to assist in the hold-down operation, the upper surface of the individual hollow platens is preferably provided with a plurality of substantially equally spaced bores which extend through the platen wall and communicate with the hollow enclosure or chamber formed within the platen. A plurality of mating bores are formed in the conveyor belt, with the conveyor belt bores being arranged to pass in running axial alignment with the bores formed in the platen. A source of vacuum is coupled to the individual platens, and as the workpieces travel along the belt, individual points along the workpiece surfaces will be exposed to a source of vacuum during those periods of time when the belt bores and platen bores are in alignment. Since the conveyor belt has a finite thickness, the belt bores become sealed, evacuated chambers while in contact with the workpieces, with the resultant force created by the vacuum tending to hold the workpieces firmly against the top surface of the upper conveyor flight.

As indicated, for preservation of the horizontal alignment of the individual workpieces with respect to the plane of the work station, the individual platens are secured to the conveyor frame in such a way that pivoting and rocking movement of the platens is accommodated along both longitudinal and transverse axes. It will be appreciated, of course, that the degree of motion or extent of movement possible for the platens is limited and/or confined, thus preserving general horizontal alignment between the workpieces and the planes of the work stations even though workpieces of varying dimensions or dimensional tolerances are being simultaneously passed through the machine in random sequence or order.

SUMMARY OF THE INVENTION

Therefore, it is a primary object of the present invention to provide an improved system for applying substantially uniform forces to individual workpieces as they move along the surface of a conveyor, and while the workpieces are being urged toward and against the surface of an orbiting wide abrasive belt in a wide belt sanding apparatus.

It is a further object of the present invention to provide an improved force-applying means to the underside or undersurface of the upper flight of a conveyor for urging workpieces against the working surface of a moving orbital sanding belt, with the force-applying means comprising a plurality of individually mounted elongated hollow platen segments of rectangular parallelepipedon configuration and disposed in side-by-side relationship, and with the axes being generally parallel, one to the other so as to collectively form a dynamic platen, and wherein air bladder means are disposed between a rigid frame and opposed ends of the platen segments for resiliently urging the platens against the undersurface of the conveyor belt.

It is yet a further object of the present invention to provide an improved force-applying means for contacting the underside or undersurface of a workpiece handling conveyor, and wherein individual intermittently mating bores are provided in the conveyor belt and the platen segments, and wherein the interior chambers of the hollow platen segments are each coupled to a source of vacuum.

Other and further objects of the present invention will become apparent to those skilled in the art upon a study of the following specification, appended claims, and accompanying drawings.

IN THE DRAWINGS

Figure 1:
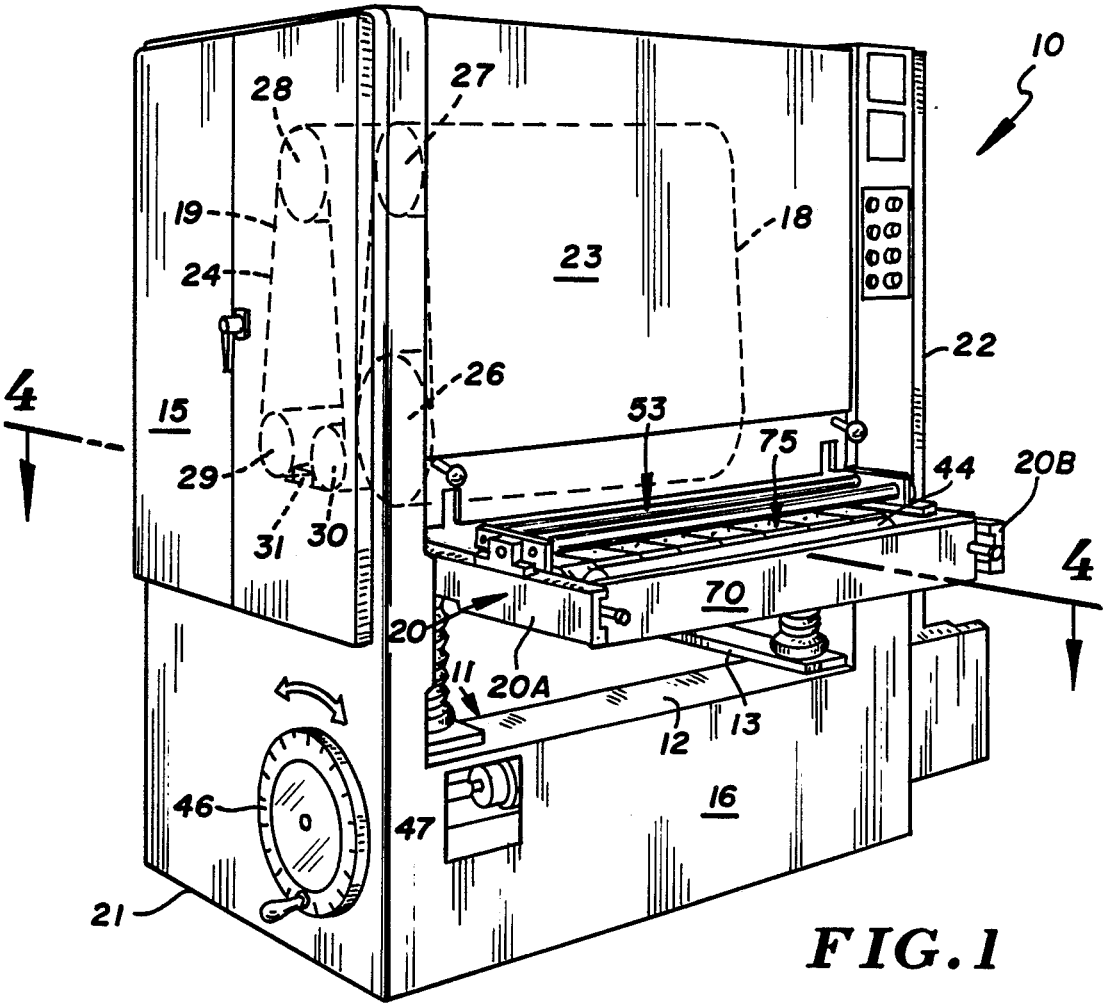
FIG. 1 is a perspective view of a wide belt sanding machine embodying the base platen and other features of the present invention, and illustrating the apparatus at the in-feed end of the conveyor, with the individual abrasive belts and their accompanying drum systems being illustrated in phantom.
Figure 3:
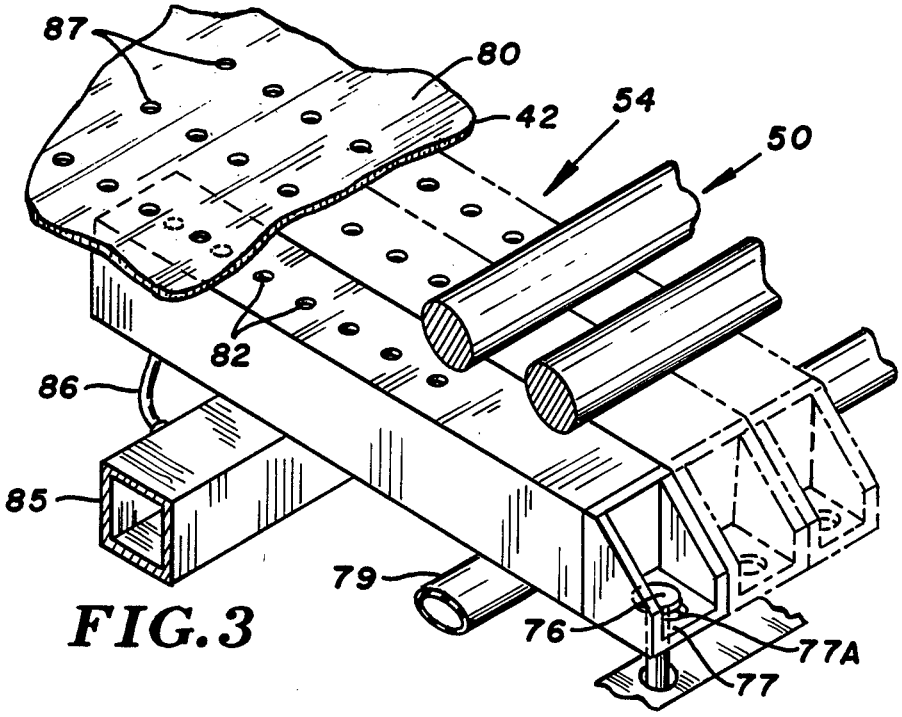
Figure 4:
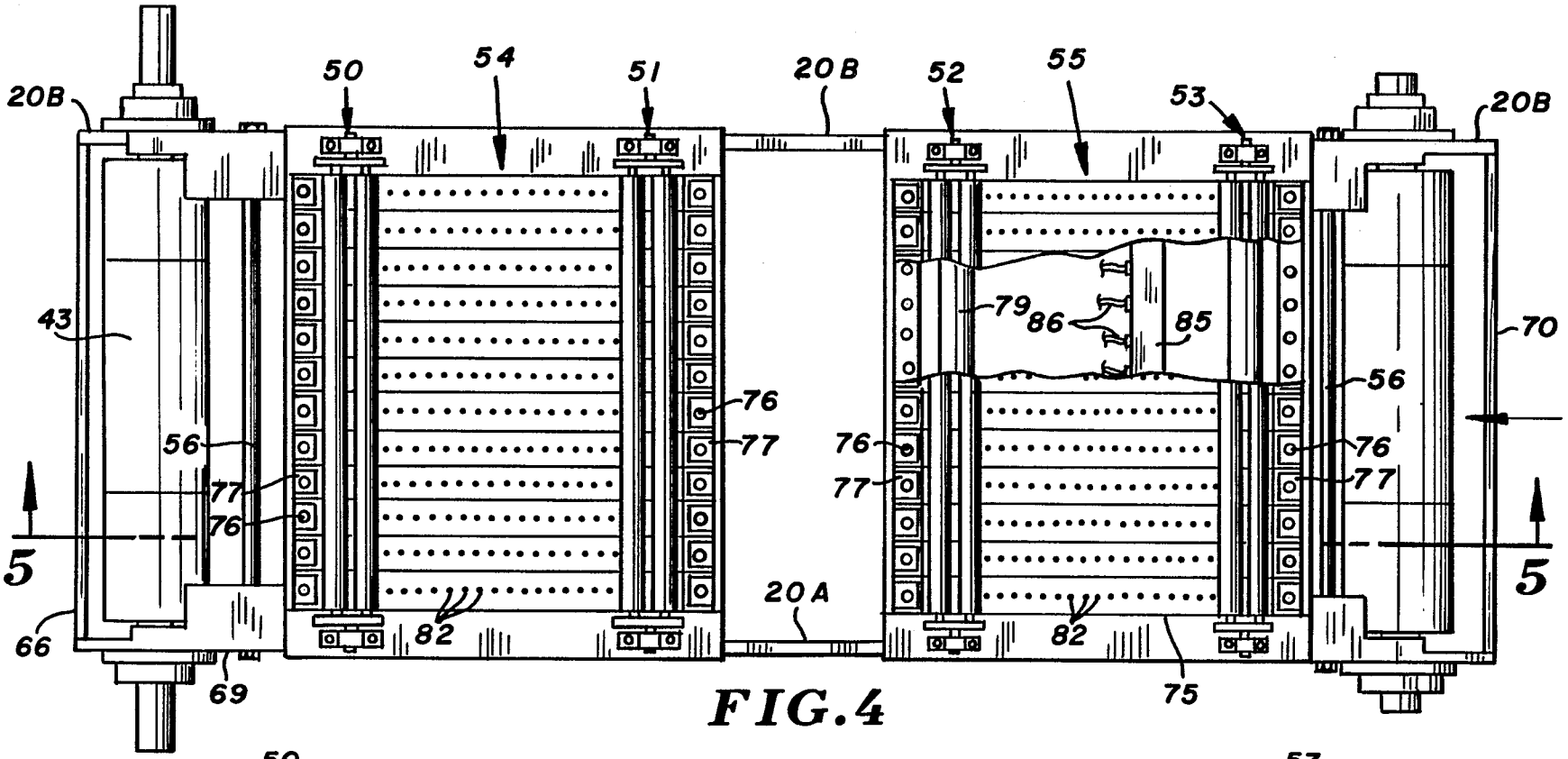
Figure 5:
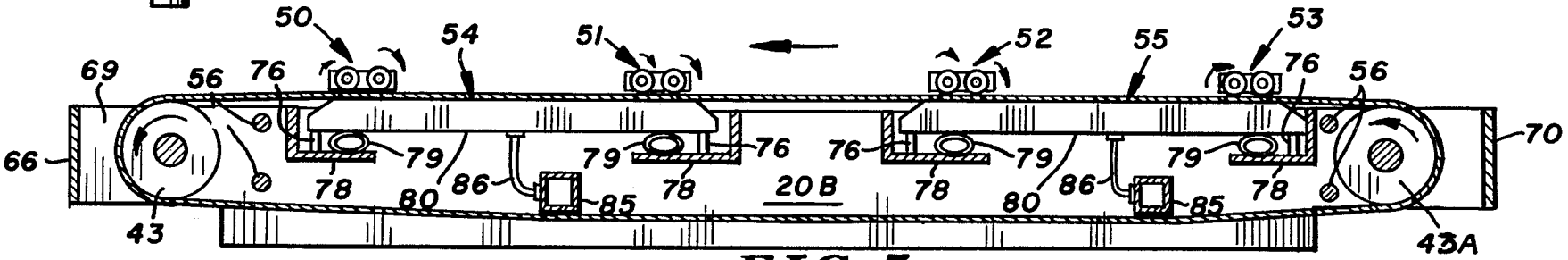
Figure 6:
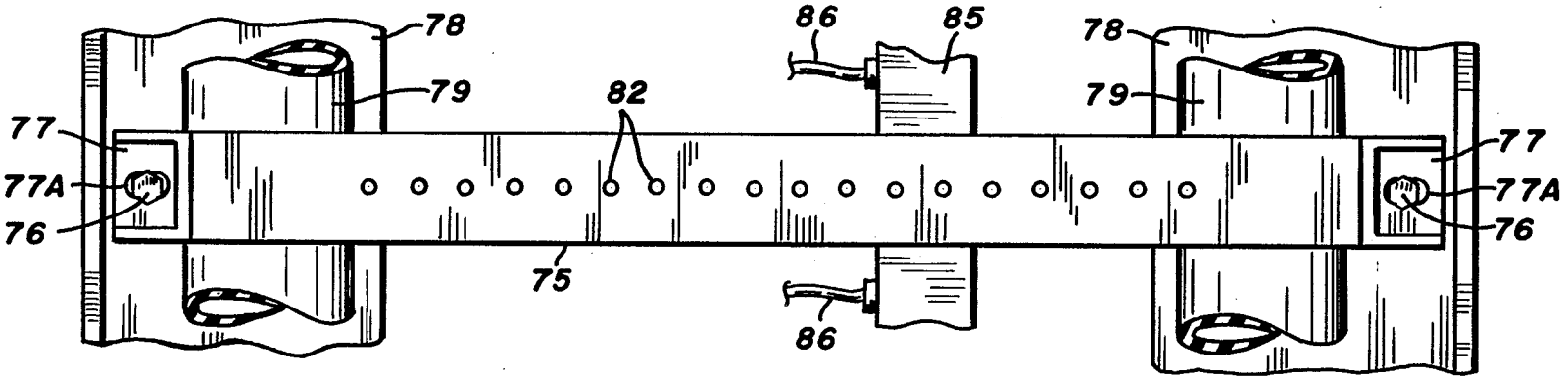
Figure 7:
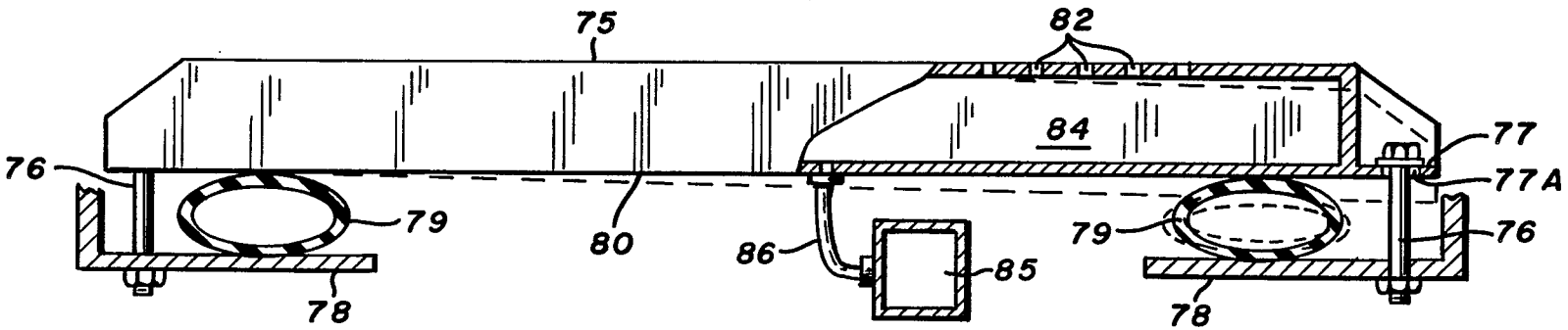

FIG. 3 is a partial perspective view of a limited number of platens arranged in accordance with and utilized in the system of the present invention, with FIG. 3 further showing fragmentary portions of the pinch rollers, the conveyor belt, a portion of one of the air bladder supports, together with a portion of the vacuum manifold and mounting means for coupling opposed ends of the platens to the frame; with FIG. 3 being shown on a slightly enlarged scale;

FIG. 4 is a top plan view, partially cut away, and illustrating a portion of the conveyor system, with the system being shown with the conveyor belt removed for purposes of clarity, with FIG. 4 being taken along the line and in the direction of the arrows 4—4 of FIG. 1;

FIG. 5 is a vertical sectional view taken along the line and in the direction of the arrows 5—5 of FIG. 4;

FIG. 6 is a top plan view of one elongated base platen segment of the type illustrated in FIGS. 1–5, with the platen segment of FIG. 6 being shown on a slightly enlarged scale; and FIG. 7 is a fragmentary vertical sectional view, partially broken away, showing one of the platens of the type illustrated in FIG. 6, along with its support structure and components.

DESCRIPTION OF THE PREFERRED EMBODIMENT

With particular attention being directed to FIGS. 1–4 of the drawings, the wide belt sanding machine generally designated 10 includes a frame means such as the frame means generally designated 11, which includes transverse rails such as rail 12, and longitudinal rails such as rail 13. Shroud means are typically provided around the machine walls including the sides, such as at 15, the front as at 16, as well as on those side walls and surfaces not visible in FIG. 1 including the side opposed to side wall 15, the rear, as well as the top and bottom wall surfaces. As indicated, machine 10 is a wide belt sanding apparatus which is equipped with two conventional sanding heads as at 18 and 19 (both illustrated in phantom in FIG. 1) along with a workpiece conveyor generally designated 20 for supplying workpieces to the sanding heads located in the "working stations". The working station may be defined as that zone delineated or disposed between the abrasive lower surface of the orbiting belt at the base of the individual belts and the top surface of the upper conveyor flight as more specifically set forth hereinafter. As indicated, the main features of the present invention reside in the segmented platen or force-applying means disposed along the undersurface of the conveyor upper flight and arranged to apply a force against the individual workpiece articles so as to urge these workpiece articles against the abrasive surface of the orbiting belt while in the working station.

The frame means 11 is preferably in the form of a weldment, and is typically provided with a supporting base portion as at 21, along with individual sides such as side 15 and oppositely disposed side 22. The sanding heads along with the system for driving the belts are coupled to the frame means in a conventional fashion, and typically may be mounted in accordance with the structure illustrated in U.S. Pat. No. 3,832,807 referred to hereinabove. Of course, other typical mounting systems may be utilized to support the weight and load of the individual sanding heads.

The individual sanding heads 18 and 19 carry endless wide abrasive belts such as belts 23 and 24, with these belts being trained over drums or orbital motion as indicated in FIG. 1. Specifically, the individual rollers or drums for the sanding heads are illustrated at 26, 27, 28, 29, and 30. Additionally, a stationary platen may be interposed between drums 29 and 30 as at 31 to provide a platen head sander in the overall arrangement. In order to provide the orbital motion to the individual belts, selected rollers for each sanding belt such as rollers 26 and 30 are power-driven.

The abrasive belt 23 carried by drums 26 and 27 in sanding head 18 which is a drum head and is typically located adjacent the in-feed end of the machine. Sanding head 19 in which endless abrasive belt 24 is trained about drums 28, 29 and 30 is arranged tandemly to drum 26, downstream from sanding head 18. Typically, the second sanding head such as sanding head 19 is in the form of a platen head, more appropriately utilized for finishing sanding operations. If desired, platen head 31 along with its adjacent drums may be driven orbitally while in operation, in accordance with the structure illustrated in copending application Ser. No. 874,342, filed June 13, 1986, Eugene C. David, entitled "WIDE BELT SANDING MACHINE WITH PLATEN OSCILLATING MEANS", and assigned to the assignee of the present invention.

As is typical, the abrasive belt orbiting in the initial sanding head 18 is supported against the thrust of the workpieces directly by its lower drum 26, whereas the belt 24 in sanding head 19 is held against the work by the position occupied by lower drums 29 and 30 along with intermediate platen head 31. The individual shafts of the drums including drums 26, 29 and 30 are typically journaled in bearings mounted on the side frame of the apparatus, and may, if desired, be held in brackets that extend from the underside of the free end portion of center bars (not shown). The individual axes of drums 26, 29 and 30 are thus fixed with respect to the conveyor. Also, as indicated, if desired, the drums 29 and 30 along with intermediate platen head 31 may be driven orbitally while abrasive belt 24 is moving thereacross. As indicated, the shafts of the lower drums of each of the sanding heads 18 and 19 are journaled in bearings mounted in the side frame 32 and in brackets 33 that depend from the underside of the free end portion of center bars 34—34.

The upper drums or rollers 27 and 28 are freely rotatably supported between the arms of yokes 35 which are supported on the center bars by the arms of air cylinders, such as cylinders 36 that are fixed to the center bars. By means of these air cylinders, the drums such as drums 27 and 28 can be raised as needed to tension the abrasive belts 23 and 24, and can be lowered to permit removal and replacement of these belts when required.

Since the orbiting abrasive belts 23 and 24 of the individual sanding heads engage the workpiece being acted upon with considerable force, and since it is necessary that the sanding heads have parallel working surfaces, it is necessary that the individual sanding heads be supported against possible angular deflection, with the support continuing to accommodate the normal removal and replacement of the abrasive belts. In this connection, therefore, the outboard end of each center bar is rigidly but separably connected with the side frame support post or element 37 in the manner disclosed in U.S. Pat. No. 3,777,442, or suitable alternate construction. The contact point as illustrated in FIG. 2 is shown at 38.

Figure 2:
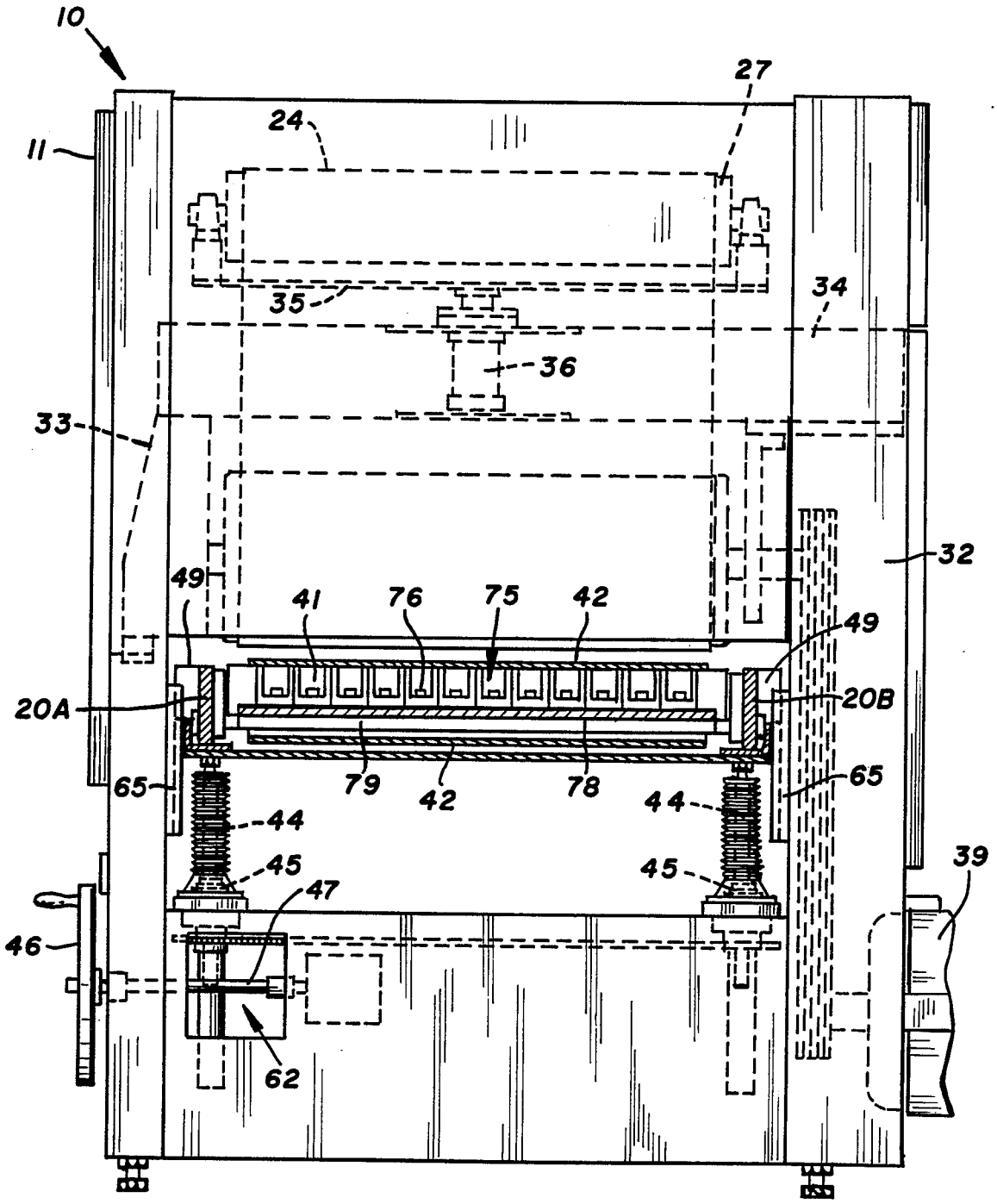
FIG. 2 is an in-feed end view of the wide belt sanding machine illustrated in FIG. 1, with certain portions and parts being broken away and others being shown in section.

As indicated, the individual endless abrasive belts 23 and 24 are orbitally driven in a conventional way by electric motors coupled to a driven drum, one of which is identified and shown as at 39 in FIG. 2, where it is shown drivingly connected with drum 26 of the first sanding head.

As illustrated in FIG. 2, the conveyor system or conveyor assembly 20 in accordance with the embodiment of the invention illustrated herein comprises a generally rigid rectangular conveyor frame 20A and a bed or platen 41 mounted on the frame 20A for limited up and down motion relative to the main frame means. An endless conveyor belt 42 is trained over conveyor rollers 43 and 43A (FIG. 5) at the in-feed and out-feed ends respectively of conveyor assembly 20. Preferably, one of the rollers 43 and/or 43A is driven, with the arrangement illustrated having roller 43 being driven. The conveyor assembly 20 acts in cooperation with pinch roller assemblies generally designated 50, 51, 52 and 53 so as to hold or press the work against the surface of the upper flight of conveyor belt 42. As indicated hereinafter, these individual pinch roller assemblies assist in drivably carrying the workpieces through the machine for the undertaking of various sanding operations thereon. As indicated, it is the upper flight of the conveyor belt 42 upon which the individual workpieces are placed, and by which these workpieces are carried into and through the machine. In order to assist in supporting the upper flight of belt 42 against the downward thrust of the pinch rollers and sanding heads, as well as to provide the feed force required for the work, the upper flight of the conveyor belt slides across the upper surface or bed of the conveyor assembly as well as across the collective base platen formed by the assembly of platen segments shown generally at 54 and 55 (FIGS. 3 and 4).

The entire conveyor assembly is supported for vertical primary adjustment on four jack screws such as shown at 44—44, with one such jack screw being disposed at each of the four corners of the frame arrangement 20A of conveyor 20. While the nuts 45—45 in which the jack screws are threaded are freely rotatably (but not longitudinally movably) mounted in the base section of the main frame, upon simultaneous rotation of the nuts, the frame and all structural members thereon may be either raised or lowered as required to adjust the machine to the proper thickness of the different workpieces to be received and worked therein. Simultaneous rotation of the nuts 45—45 is effected by turning or rotating hand wheel 46 which is drivingly connected with the nuts through a conventional transmission, part of which is indicated at 47 in FIG. 2.

Since all four jack screws rotate simultaneously and at the same rate during adjustment of the elevation of the conveyor assembly, the conveyor frame 20A may be moved upwardly and downwardly with a translatory motion and, to guide that motion, lugs 49—49 that are fixed to and project outwardly from the side rails 20B—20B of the conveyor frame 20A, ride in vertical guideways 65 on the adjacent side sections of the main frame.

The conveyor frame 20A, in addition to the side rails 20B has an in-feed cross-member such as at 66 which connects opposite ends of the rails, along with two pairs of intermediate cross-members or tie-rods such as 56—56.

The conveyor assembly 20 is preferably formed of steel and is provided with a flat top or upper surface. Support may be provided from side flanges 69—69 and end flanges 66 and 70. Stiffening rods such as at 71—71 may be provided, if needed.

The conveyor bed comprises a pair of collective base platens 54 and 55, each comprising a plurality of individual elongated platen members or segments 75—75. Each of the individual platen segments 75 is mounted or otherwise secured to conveyor frame 20 by means of loosely fitting or resiliently sleeved bolts 76—76, with the bolts 76 passing through the reinforced end plates 77—77 of the platen segment members 75 and through horizontal flange or bracket 78. Air bladder means as at 79 are provided between the horizontal flange 78 and the undersurface 80 of platen segments 75, with the air bladders 79—79 extending transversely across and beneath the individual arrays of platen segments forming collective platens 54 and 55. These air bladders 79—79, being arranged at opposed ends of the elongated platen segments resiliently urge the elongated platen segments against the undersurface of conveyor belt 42.

As indicated, the elongated mounting bolts 76—76 which are preferably mounted in slots 77A formed at the ends of the platen segments permit the individual platen segments to move downwardly away from sanding heads in the working station, and additionally accommodate a number of degrees of both pivotal and rockable movement about both longitudinal and transverse axes of each of the platen members or segments 75—75.

The upper surface of each of the platen members has a plurality of bores formed therein as at 82—82. These bores are disposed generally along the longitudinal axis of each of the platens at generally uniformly spaced intervals therealong. Additionally, the bores communicate with the interior of the platen members, such as the hollow interior forming or defining chambers 84—84.

In order to provide a source of vacuum to each of the individual platen segments, a vacuum manifold is provided as at 85 having a line such as at 86 coupling the interior chambers 84 of the individual platen segments to the vacuum manifold 85.

As indicated, conveyor belt 42 contains perforations or bores such as at 87—87. These bores are arranged in axial alignment with the bores 82 formed in the individual platen segments. However, in order to properly utilize and to preserve the adequacy of the vacuum source, the mutually adjacent belt bores 87—87 are arranged in out-of-phase spaced relationship with mating mutually adjacent platen bores 82—82. In this connection, therefore, the spacing for the bores 87—87 in the belt may be arranged to be somewhat less than the bore-to-bore spacing on the platen bores 82—82, thereby providing the out-of-phase spaced relationship.

With attention being directed to FIG. 4 of the drawings, it will be observed that the individual platens 75—75 comprising the collective platens 54 and 55, are interposed at locations generally spanning the adjacent pinch roll pairs 50–51 and 52–53, with the overall length of the platens generally exceeding the span between the individual pinch roll pairs. For example, pinch roll pairs 52–53 are spaced apart a distance somewhat less than the overall length of the platen segments 75—75.

In actual operation, therefore, the sanding heads 18 and 19 will generally be positioned so that the working stations defined at the zone where contact is made between the abrasive surface of the belt moving through the sanding head and the work are generally located in the zones immediately above the center or mid-point of the length of the platens 75—75 comprising the collective platens 54 and 55, and generally midway between the pinch roll pairs 52 and 53.

The resilient forces applied by the air bladders 79—79 are used to provide a uniform, consistent and controllable resistance to the downward thrust exerted on the platen segments when work carried on conveyor assembly 20 is passing through the machine. These air bladders are rubber-walled chambers such as those sold by the Firestone Rubber Company under its trade designation "Firestone AirMount". As indicated, the air bladders 79—79 are seated upon rigid cross-members coupled to the frame each in line with and under one end of the platens 75—75 comprising collective platens 54 and 55. All air bladders are connected with a source of air pressure as may be indicated, with the bladders being filled to whatever internal pressure is desired. Air bladders have in the past been used in conjunction with wide belt sanding apparatus for a variety of other purposes.

The air bladders may have either high or low internal pressure, depending upon the work desired. Also, in the event a source of pressure may be desirably provided to controllably adjust the pressure to whatever level is desired, one apparatus may be utilized, such as that certain apparatus disclosed in U.S. Pat. No. 3,832,807, Kiser and Stinn, referred to hereinabove.

Accordingly, the apparatus of the present invention is relatively quickly adjustable to maintain any selected or desired feed force or resistance to downward thrust resulting from operative contact between the workpieces and the abrasive sanding belt. Both dimensional reduction and finishing sanding operations may be accomplished in a single pass of the work through the apparatus disclosed. If desired, therefore, the internal air pressure available in the bladders disposed beneath the platen head 31 may be reduced to a level less than that present in the air bladders beneath the drum-head sander, particulalry if the necessary removal is accomplished in the drum-head portion. Thus, depending upon the extent of variables found in the dimensions of the lumber pieces or workpieces entering the system, the individual platen segments 75—75 may rock about their longitudinal and/or transverse axes so as to accommodate these dimensional differences. Also, the workpieces may be distributed and passed through the system on a random basis, thereby achieving a desired finished result without requiring constant shifts and/or re-positioning adjustments in the conveyor system relative to the sanding heads. The utilization of cooperating vacuum ports in both the platens and the conveyor belt assist in hold-down of workpiece as they pass beneath the sanding heads. The pinch rolls, such as indicated at 50–51 and 52–53 further assist in hold-down of the work, however the combination of pinch rolls together with cooperating vacuum ports in the conveyor belt and the platens assists in maintaining the workpieces, particularly small workpieces, in properly held-down disposition as they are passed through the apparatus for contact with the abrasive belts.

It will be appreciated that the features set forth in the system disclosed herein may be modified by those skilled in the art without departing from the spirit and scope of the present invention.

What is claimed:

1. In a wide belt sanding machine having main frame means, an abrasive working station comprising a power-driven endless wide sanding belt mounted upon said main frame, a workpiece conveyor operatively mounted on said main frame and having an endless wide workpiece carrying belt with a generally horizontally disposed upper flight positioned to convey individual workpieces into said working station where the workpiece surfaces make contact with the surface of the endless sanding belt, and improved force-applying means disposed along the undersurface of said conveyor upper flight for urging said workpieces against the surface of said sanding belt while in said working station; the improvement comprising:

(a) said force-applying means comprising a plurality of elongated hollow platens of rectangular parallelepipedon configuration and disposed in side-by-side relationship with the axes thereof being generally parallel to the axis of the upper flight of said conveyor belt and with the interior of said hollow platens defining an enclosed chamber;

(b) air bladder means disposed between said frame means and the opposed ends of said elongated platens for resiliently urging said elongated platens against the undersurface of said conveyor belt;

(c) means coupling the opposed ends of each of said elongated platens to said main frame and for accommodating pivoting and rocking movement of each of said elongated platen members about both longitudinal and transverse axes;

(d) the upper surface of each of said platen members having a plurality of bores formed generally along the axis thereof, at generally uniformly spaced first intervals therealong, and in communication with said platen chamber; and (e) means coupling said platen chamber to a source of vacuum.

2. The wide belt sanding machine as defined in claim 1 being particularly characterized in that said conveyor belt has bores formed therethrough at generally uniformly spaced second axial intervals therealong, and arranged to pass in running axial alignment with the bores formed in said platens, said first and second spaced intervals being unequal one to the other, the arrangement being such that whenever a given bore in said conveyor belt overlies a platen bore, the mutually adjacent belt bores are out-of-phase with neighboring mutually adjacent platen bores.

* * * * *